US006196133B1

(12) United States Patent
Fitzler et al.

(10) Patent No.: US 6,196,133 B1
(45) Date of Patent: Mar. 6, 2001

(54) DEVICE FOR SUSPENSION OF A HOLLOW SECTION RAIL WHICH OPENS DOWNWARD IN A SUSPENSION CRANE

(75) Inventors: Stefan Fitzler, Iserlohn; Rüdiger Ostholt, Wetter, both of (DE)

(73) Assignee: Mannesmann AG, Düsseldorf (DE)

( * ) Notice: Subject to any disclaimer, the term of this patent is extended or adjusted under 35 U.S.C. 154(b) by 01 day.

(21) Appl. No.: 09/196,032

(22) Filed: Nov. 19, 1998

(30) Foreign Application Priority Data

Nov. 20, 1997 (DE) ..... 197 53 169

(51) Int. Cl.[7] ..... B61B 11/00
(52) U.S. Cl. ..... 105/148; 104/89
(58) Field of Search ..... 104/89, 91, 111, 104/93, 95; 105/148, 106, 107; 403/4, 337, 3; 248/228.1, 228.4; 16/94 R, 94 D

(56) References Cited

U.S. PATENT DOCUMENTS

| | | | | |
|---|---|---|---|---|
| 2,156,827 | * | 5/1939 | Wehr | 104/111 |
| 3,039,401 | * | 6/1962 | Bishop | 104/111 |
| 3,929,078 | * | 12/1975 | Sears | 104/111 |
| 5,549,049 | * | 8/1996 | Deandrea | 104/111 |
| 5,598,785 | * | 2/1997 | Zaguroli, Jr. | 104/111 |

FOREIGN PATENT DOCUMENTS

2508317 * 8/1975 (DE) .

OTHER PUBLICATIONS

Brochure: "Kranbaukasten KBK: Anlagen für den flurfreien Materialtransport", Jun. 1995.

* cited by examiner

*Primary Examiner*—Russell D. Stormer
*Assistant Examiner*—Robert J. McCarry, Jr.
(74) *Attorney, Agent, or Firm*—Cohen, Pontani, Lieberman & Pavane

(57) ABSTRACT

A device for the suspension of a rail, especially of a hollow-section rail which opens downward in a suspension crane, includes a carrying apparatus with a traction element which has two ends. One of the ends of the traction element may be fasten to the rail. To provide a rigid suspension of a rail in which horizontal forces, especially pulse-like horizontal forces, are extensively damped, the device includes a rubber-metal element connected between the carrying apparatus and the traction element with two substantially horizontal metal carriers arranged at a distance from one another. A rubber or elastic element is fastened to the inner surfaces of the metal carriers, which inner surfaces face one another. The carrying apparatus is fixedly connected with the lower metal carrier and the other end of the traction element is fixedly connected with the upper metal carrier.

6 Claims, 3 Drawing Sheets

DEVICE FOR SUSPENSION OF A HOLLOW SECTION RAIL WHICH OPENS DOWNWARD IN A SUSPENSION CRANE

BACKGROUND OF THE INVENTION

1. Field of the Invention

The invention is directed to a device for the suspension of a hollow-section rail in an overhead or suspension crane which opens downward.

2. Description of the Related Art

A prior art hollow-section rail which opens downward for a suspended rail system is disclosed in the brochure titled "Kranbaukasten KBK (KBK Crane Construction Kits)", for a crane construction kit manufactured by Mannesmann Demag Fördertechnik AG. A lifting device is movable in the longitLudinal direction of the suspended rail system by trolley rails. The rail is suspended in pendulum fashion so as to be swivelable, at a carrying apparatus or a transverse girder by vertically arranged, elongate girders or traction elements, wherein the lower ends of the traction elements are fastened to the rail and the upper ends are fastened to the carrying apparatus or transverse girder. The pendulum type suspension ensures that the suspension path automatically adjusts to the state of equilibrium. The state of equilibrium is the state in which there are no horizontally acting forces and all forces are directed vertically downward. The pendulum type suspension is ensured in that the ends of the girders are provided with ball heads which are articulated in matching ball sockets at the rail or at the carrying apparatus. In the case of pendulum type suspension, shock-like loading of the rails in particular is transformed into vibrational energy, the rails proceed back to their initial position again in the form of damped oscillations.

The pendulum type suspension described above is not suitable for a suspension crane, especially with a laterally projecting boom, because upwardly directed vertical forces are not absorbed.

Consequently, as an alterinative solution in a suspension crane with a laterally projecting boom, only a rigid suspension of the rails is taken into consideration. The rigid suspension has the disadvantage that pulse peaks occurring during shocks may destroy or damage the suspension path and ceiling construction because, in these cases, besides the forces that are favorably absorbed by the suspension system, short-term horizontal forces with very large amplitudes also occur. But horizontal forces also occur during normal operation of the suspension crane, specifically because of bending or sagging of the rails between the individual suspension points. These horizontal forces during normal operation likewise represent an intensive loading of the suspension path which manifests itself over the course of time by increased wear.

SUMMARY OF THE INVENTION

It is an object of the present invention to provide a rigid suspension of a rail in which horizontal forces, especially shock-like or pulse-like horizontal forces, are extensively damped.

This object is met by device for the suspension of a rail which includes a carrying apparatus with a traction element that has two ends. One of the ends of the traction element is fastenable to the rail. To provide a rigid suspension of a rail in which horizontal forces, especially pulse-like horizontal forces. are extensively damped, the device includes a rubber-metal element connected between the carrying apparatus and the traction element with two substantially horizontal metal carriers arranged at a distance from one another and having inner surfaces which face each other. A rubber or elastic element is fastened to the inner surfaces of the metal carriers. The carrying apparatus is fixedly connected with the lower metal carrier and the other end of the traction element is fixedly connected with the upper metal carrier so that at least the peak pulses of horizontal forces exerted on the traction element are damped by the elastic element.

In a device for the suspension of a rail at a carrying apparatus with a traction element having first end fastenable to the rail. the invention provides that an intermediate rubber-metal element with two substantially horizontal metal carriers arranged at a distance from one another is connected between the carrying apparatus and the traction element. A rubber element is fastened to the inner surfaces of the metal carriers. The carrying apparatus is fixedly connected with the lower metal carrier and the second end of the traction element is fixedly connected with the upper metal carrier. The flux of force passes over the traction element to the upper metal carrier which is supported on the rubber element. The rubber element which is formed as an intermediate layer lies on the lower metal carrier which is fastened to the carrying apparatus. The intimate connection between the rubber element and the inner surface of the metal carrier prevents the free displacement of the metal carriers relative to one another. At the same time, this connection ensures, in combination with the elastic rubber element, that horizontal force peaks occurring in a pulse-like manner are intercepted or damped. In this way, the horizontal force peaks are transformed into damped oscillations with very low amplitudes.

An intimate connection between the rubber element and the metal carriers is achieved in that the rubber element is vulcanized to the metal carriers.

A compact rubber-metal element with uniform distribution of load is achieved by a construction in which the second end of the traction element connected with the upper metal carrier is guided through a vertical opening of the rubber-metal element while leaving an intermediate space between the sides of the traction element and the rubber metal element.

A connection between the traction element and metal carriers which is rigid against bending is achieved by the use of a spacer element which contacts the upper metal carrier, wherein the end of the traction element is guided through this spacer element.

The spacer element is preferably fastened to the upper metal carrier. In a simple embodiment form, the spacer element is a vertically arranged hollow cylinder having an end face fastened against the upper metal carrier. The end face of the traction element which is fixedly connected to the upper metal carrier is provided with an external thread in the region of the lower metal carrier, wherein a nut pressing the spacer element against the upper metal carrier is screwed onto the external thread to produce a stable connection between the metal carrier and the traction element which is substantially rigid with respect to vertical forces and is quasi-rigid with respect to horizontal forces.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
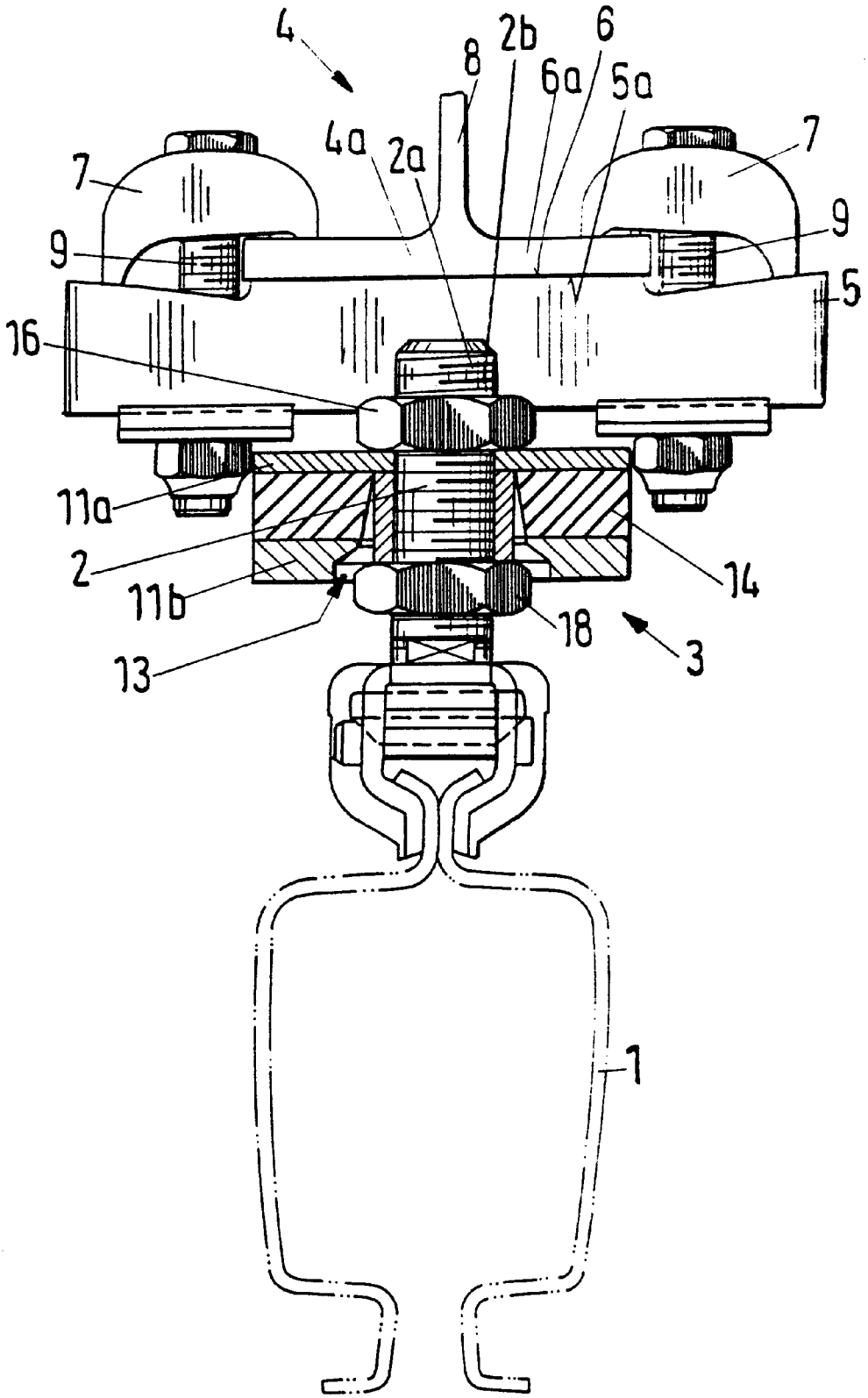
FIG. 1 is a partial cross-sectional view of a device for the suspension of a rail according to embodiment of the present invention.
Figure 2:
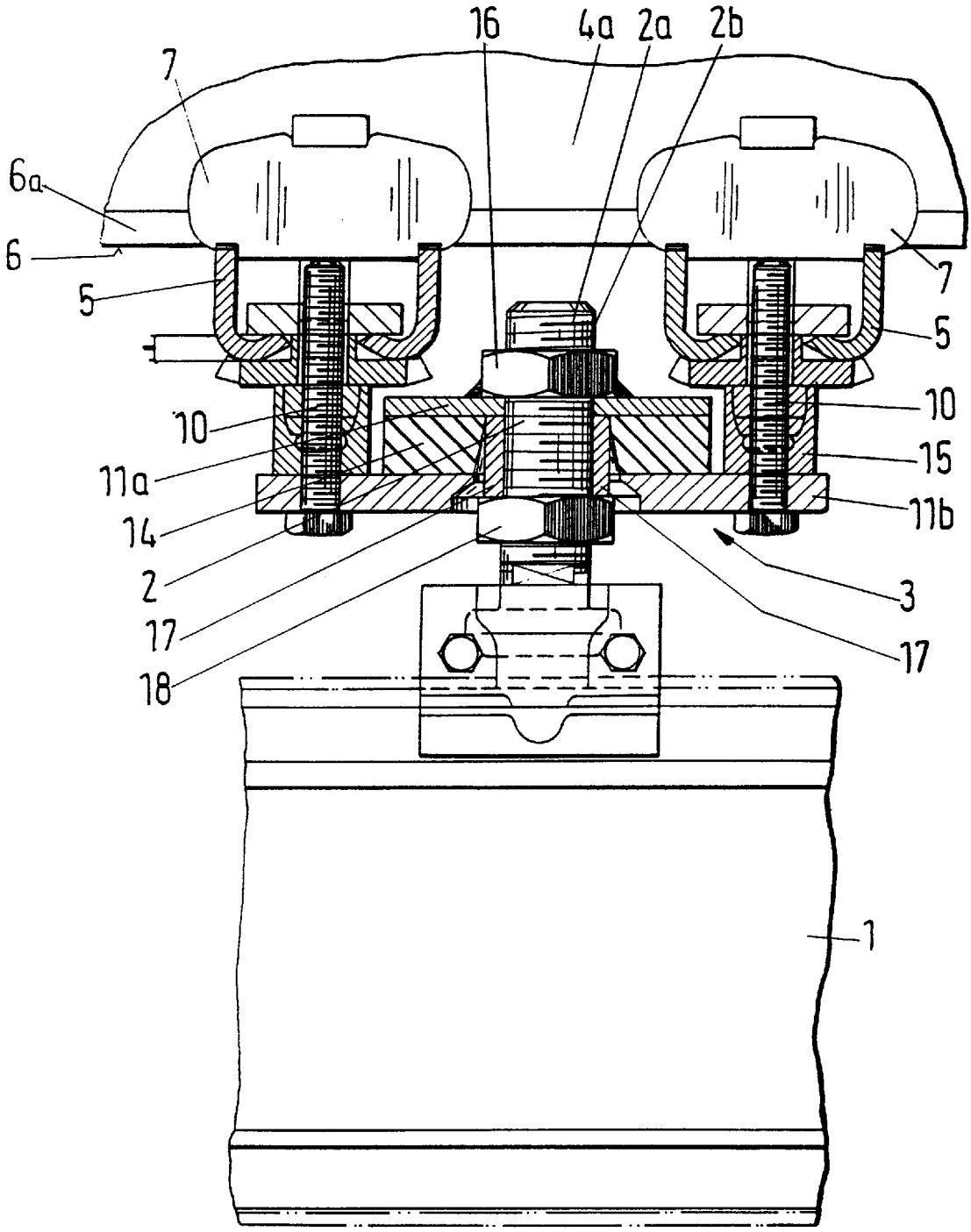
FIG. 2 is a partial longitudinal sectional view of a side of the device of FIG. 1.

FIG. 1 and FIG. 2 show a device for the suspension of a hollow-section rail 1 for, by way of non-limiting example, a suspension crane, which opens downward. The rail 1 is connected to a carrying apparatus 4 by a traction element 2 via a rubber-metal element 3. The rubber-metal element 3 is an intermediate element connected between the carrying apparatus 4 and the traction element 2. The carrying apparatus 4 is constructed as a T-girder 4*a* in the embodiment shown in FIGS. 1 and 2 having a web 8 and a flange 6*a*. An upper edge 5*a* of a U-shaped transverse girder 5 which contacts a lower outer surface 6 of the T-girder 4*a* fastens the rubber-metal element 3 to the T-girder 4*a*. The fixed connection between the lower outer surface 6 and the transverse girder 5 is produced by brackets or plates 7 which are supported on both sides of the web 8 on the inner side of the flange 6*a* and on the transverse girder 5 extending beyond the width of the flange 6*a*. The plates 7 and the transverse girder 5 are screwed together in a fixed manner by a screw 9 which is inserted through corresponding bore holes in the plate 7 and in the transverse girder 5. The plate 7 which simultaneously contacts the inner side of the flange 6*a* causes the flange 6*a* and the transverse girder 5 to be fixedly connected.

Figure 3:
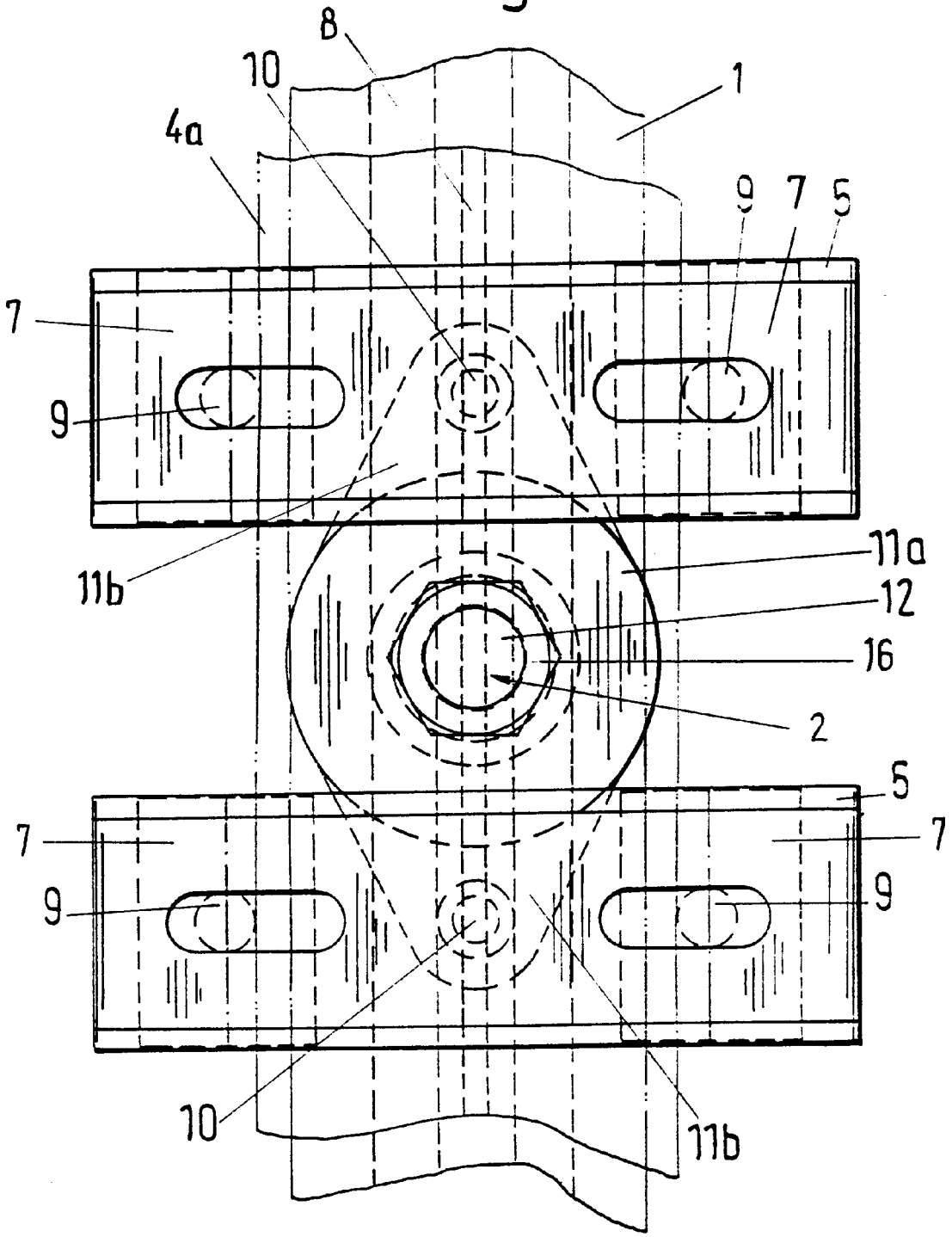
FIG. 3 is a schematic top view of the device in FIG. 1

In a simplified top view. FIG. 3 shows that two transverse girders 5 are arranged parallel to one another and at a distance from one another for every suspension point, considered in the longitudinal direction of the T-girder 4, in such a way that the screws 9 form the corner points of an imaginary square (of course, a rectangle is also possible). A traction element 2 is fastened in the center of the square in the case of two transverse girders 5.

The U-section-shaped cross section of the transverse girders 5 is seen clearly from FIG. 2. The transverse girders 5 are fixedly connected with the rubber-metal element 3 in the longitudinal direction of the T-girder 4*a* vertically below the web 8.

The rubber-metal element 3 comprises two substantially horizontal metal carriers 11*a*, 11*b* which are constructed as metal plates and are separated by a vertical distance from one another. FIG. 3, in particular, shows that the metal carrier 11*a* is a circular disk with a central opening 12. The central opening 12 is arranged at a distance vertically over a central opening 13 of the lower metal carrier 11*b*. Seen from above, opposing sides of the lower metal carrier 11*b* extend in opposite directions beyond the outer contour of metal carrier 11*a*. A rubber plate 14 is sandwiched between the metal carriers 11*a* and 11*b* at their inner surfaces which face one another and is fastened thereto. In the embodiment example, the fastening is accomplished by vulcanizing the rubber to the metal carriers 11*a*, 11*b*. Of course, instead of rubber, any other kind of elastic or flexible material, which need not necessarily be vulcanized, may also be used. It is likewise possible to (glue the rubber plate 14 or elastic material to the inner surfaces of the metal carriers 11*a*, 11*b* with any suitable adhesive. In addition, the plate-shaped construction of the rubber plate 14 is only a special construction of the rubber-metal element 3, which may comprise many other construction forms.

The rubber plate 14 also has an opening which is aligned with openings 13, 14, so that the traction element 2 is insertable through the entire opening of the rubber-metal element 3 extending in the vertical direction.

The lower metal carrier 11*b* is fixedly connected to the transverse girders 5 by means of connecting elements 10 such, for example, as screws and spacer elements 15 and is accordingly fixedly connected with the carrying apparatus 4 by the transverse girders 5. An end 2*a* of the traction element 2 has an external thread 2*b*, is inserted by this end 2*a* through the openings 12 and 13 and is fastened to the upper metal carrier 11*a*. Fastening is carried out in this case by a nut 16 or any other threaded element which is screwed onto the end 2*a*. The threaded element is optionally soldered or welded to the upper metal carrier 11*a* to facilitate handling of the assembled device. As depicted in FIGS. 1 and 2, the end 2*a* of the traction element 2 is inserted through a spacer element 17 comprising a hollow cylinder. One end of the spacer element 17 contacts the inner surface of the upper metal carrier 11*a*. The spacer element 17 is pressed or axially clamped against the upper metal carrier 11*a* by a second nut 18 threaded onto the lower end of the traction element 2. This results in a connection between the traction element 2 and the upper metal carrier 11*a* which is rigid against bending. The rail 1 is fastened in an articulated manner to the other end of the traction element 2 in a known manner.

During operation of the suspension crane, the tractive and compressive forces directed vertically upward and downward are transmitted to the carrying apparatus by the rubber-metal element 3 in the manner of a rigid connection. However, for pulse-like horizontal force peaks caused, for example, by shocks, the upper metal carrier 11*a* is horizontally displaced with respect to the lower metal carrier 11*b* due to the elastic effect of the rubber 14. This elastic deformation of the rubber 14 intercepts the pulse peaks. Therefore, the rubber-metal element 3 acts like a quasi-rigid intermediate element which exhibits its elastic characteristics essentially only in the case of horizontal forces.

The invention is not limited by the embodiments described above which are presented as examples only but can be modified in various ways within the scope of protection defined by the appended patent claims.

We claim:

1. A device for suspending a rail, comprising:

a carrying apparatus;

a traction element having a first end fastenable to the rail and a second end;

an intermediate element connected between said carrying apparatus and said traction element and having an upper horizontal metal carrier and a lower horizontal metal carrier separated by a vertical distance and having inner surfaces facing each other;

said intermediate element further comprising an elastic element fastened to said inner surfaces of said upper horizontal metal carrier and said lower horizontal metal carrier;

wherein said carrying apparatus is fixedly connected with one of said upper horizontal metal carrier and said lower horizontal metal carrier and said second end of said traction element is fixedly connected with the other of said upper horizontal metal carrier and said lower horizontal metal carrier, wherein said intermediate element further comprises a spacer element contacting said other of said upper horizontal metal carrier and said lower horizontal metal carrier and said second end of said traction element is guided through said spacer element, and wherein said elastic element of said intermediate element is arranged so that said intermediate element damps pulse peaks of horizontal forces received by said traction element.

2. The device of claim 1, wherein said elastic element comprises rubber and is vulcanized to said inner surfaces of said upper horizontal metal carrier and said lower horizontal metal carrier.

3. The device of claim 1, wherein said second end of said traction element is guided through a vertical opening of said intermediate element while leaving an intermediate space between said traction element and said intermediate element.

4. The device of claim 1, wherein said spacer element is fastened to the other of said upper horizontal metal carrier and said lower horizontal metal carrier.

5. The device of claim 1, wherein said spacer element comprises a vertically arranged hollow cylinder having an end face fastened to the other of said upper horizontal metal carrier and said lower horizontal metal carrier.

6. The device of claim 5, wherein said second end of said traction element comprises an external thread and a fastening device is threadably fastened on said external thread of said traction element for pressing said spacer element against the other of said upper horizontal metal carrier and said lower horizontal metal carrier.

* * * * *